US011512901B2

(12) United States Patent
Khaire et al.

(10) Patent No.: US 11,512,901 B2
(45) Date of Patent: Nov. 29, 2022

(54) ADJUSTABLE CAPACITY HEAT EXCHANGER

(71) Applicant: Rheem Manufacturing Company, Atlanta, GA (US)

(72) Inventors: Swapnil Khaire, Fayetteville, AR (US); Harshad Inamdar, Fayetteville, AR (US)

(73) Assignee: RHEEM MANUFACTURING COMPANY, Atlanta, GA (US)

( * ) Notice: Subject to any disclaimer, the term of this patent is extended or adjusted under 35 U.S.C. 154(b) by 137 days.

(21) Appl. No.: 17/032,538

(22) Filed: Sep. 25, 2020

(65) Prior Publication Data

US 2022/0099375 A1 Mar. 31, 2022

(51) Int. Cl.

| | |
|---|---|
| ***F28D 1/053*** | (2006.01) |
| ***F28F 1/00*** | (2006.01) |
| *F25B 39/04* | (2006.01) |

(52) U.S. Cl.

CPC ..... *F28D 1/05391* (2013.01); *F28F 1/006* (2013.01); *F24D 2220/06* (2013.01); *F25B 39/04* (2013.01); *F25B 2600/2501* (2013.01)

(58) Field of Classification Search

CPC ..... F28D 1/05391; F28F 1/006; F28F 13/06; F24D 2220/06; F24D 19/0073

See application file for complete search history.

(56) References Cited

U.S. PATENT DOCUMENTS

| | | | | |
|---|---|---|---|---|
| 6,679,434 | B2 * | 1/2004 | Okumura | B60H 1/00028 237/12.3 B |
| 7,771,664 | B2 * | 8/2010 | Ashe | G01N 25/42 422/198 |
| 8,578,731 | B2 | 11/2013 | Jin | |
| 9,828,275 | B2 * | 11/2017 | Kang | F28F 27/00 |
| 2005/0269062 | A1 * | 12/2005 | Guerrero | F01P 7/165 165/101 |
| 2006/0150667 | A1 * | 7/2006 | Lee | F28F 27/02 62/507 |
| 2009/0183867 | A1 * | 7/2009 | Bales | F28F 27/02 165/158 |
| 2013/0149119 | A1 * | 6/2013 | Seo | F28F 27/02 165/104.33 |

(Continued)

FOREIGN PATENT DOCUMENTS

| | | | |
|---|---|---|---|
| FR | 2824755 | A1 | 11/2002 |
| RU | 2612668 | C1 | 3/2017 |

(Continued)

OTHER PUBLICATIONS

International Search Report and Written Opinion for PCT Application No. for PCT Application No. PCT/US2021/051929 dated Dec. 16, 2021.

*Primary Examiner* — Devon Russell
(74) *Attorney, Agent, or Firm* — Eversheds Sutherland (US) LLP

(57) ABSTRACT

Disclosed herein is a heat exchanger apparatus comprising a heat exchanger tube having an inlet valve and an outlet valve. When the valves are open, the refrigerant can flow through the heat exchanger tube, and when the valves are closed, refrigerant can be stored in the heat exchanger tube, thereby reducing the effective heat exchange surface area of the heat exchanger apparatus.

18 Claims, 6 Drawing Sheets

(56) References Cited

U.S. PATENT DOCUMENTS

| | | | | |
|---|---|---|---|---|
| 2014/0020865 | A1* | 1/2014 | Maruyama | F28D 1/0435 165/103 |
| 2014/0262200 | A1* | 9/2014 | Sheppard | G05D 23/022 137/637.1 |
| 2016/0341447 | A1 | 11/2016 | Carla | |
| 2018/0024582 | A1 | 1/2018 | Butikofer et al. | |
| 2018/0037235 | A1 | 2/2018 | Otake | |

FOREIGN PATENT DOCUMENTS

| | | | |
|---|---|---|---|
| SU | 1746202 | A1 | 7/1992 |
| WO | 2011038105 | A2 | 3/2011 |

* cited by examiner

ADJUSTABLE CAPACITY HEAT EXCHANGER

FIELD OF THE DISCLOSURE

The present disclosure relates generally to heat exchangers and, in particular, to adjustable capacity heat exchangers.

BACKGROUND

Heat exchangers are widely used to transfer heat from one fluid to another, such as in heating, ventilation, and air conditioning (HVAC) applications. Typically, to heat or cool a target fluid, the target fluid is passed through the heat exchanger, which includes an array of heat exchanger tubes. To enhance heat transfer efficiency, fins are often installed along the heat exchanger tubes. A temperature-controlled fluid (e.g., heated, cooled) is passed through the heat exchanger tubes, and heat can thus be transferred between the target fluid and the temperature-controlled fluid via the heat exchanger tubes and the fins.

As a more specific example, air conditioners can utilize heat exchangers to provide cooled air for a building through the refrigeration cycle. A cold refrigerant is routed through the heat exchanger tubes of an evaporator. A blower or fan can be used to force ambient internal air to move across the heat exchanger, at which time heat is transferred from the warm internal air to the heat exchanger tubes and/or fins and from the heat exchanger tubes and/or fins to the flowing refrigerant.

Recently, there has been an increase in demand for air conditioning systems and other heat exchanging systems that have increased efficiency and versatility. Because many air conditioning systems have the ability to provide both heated and cooled air for a building, developments such as heat pump systems have greatly improved the efficiency, affordability, and versatility of existing air conditioning systems. Similarly, multi-speed air conditioning systems provide an increased level of efficiency and versatility over a wide range of temperatures.

A problem with heat pump systems, however, is that a refrigerant imbalance can be caused when there is a difference between an outdoor coil volume and an indoor coil volume. Moreover, for systems able to switch between a heating mode and a cooling mode, the necessary charge volume can change depending on the mode. That is, when switching between cooling and heating applications, refrigerant must be either added or taken away from the system to retain a proper heat exchange. To address this variance in charge required for operation, many systems include an additional component called a charge compensator, which is configured to store, or withdraw from circulation, an amount of refrigerant when the system is in heating mode and returning that amount of refrigerant back into circulation when the system is in cooling mode, or the opposite—withdrawing an amount of refrigerant from circulation when the system is in cooling mode and returning that amount of refrigerant back into circulation when the system is in heating mode—depending on the particular circumstances. Inclusion of the charge compensator can invite a host of problems, including the costs and inconvenience associated with purchasing, installing, and maintaining an additional device.

Additionally, most multi-speed systems are designed to operate at or near their capacity during high-speed operation, meaning that such systems are overdesigned for low and/or intermediate speed operation.

What is needed, therefore, are adjustable capacity heat exchanges that can have an increased efficiency when accommodating dissimilar outdoor and indoor volumes as well as variable speed operations. The present disclosure addresses this need as well as other needs that will become apparent upon reading the description below in conjunction with the drawings.

BRIEF SUMMARY

The present disclosure relates generally to heat exchangers and, in particular, to adjustable capacity heat exchangers. The disclosed technology can include a heat exchanger apparatus comprising a heat exchange tube configured to direct a refrigerant flow therethrough. The heat exchange tube can have an inlet valve, an outlet valve, and a tube portion being defined between the inlet valve and the outlet valve.

The heat exchanger apparatus can be configured to fluidly communicate with a refrigerant circuit. When the inlet valve and the outlet valve are open, the refrigerant flow can be permitted to flow through the tube portion such that the refrigerant circuit has a first amount of refrigerant circulating therethrough, and the heat exchanger apparatus can provide a first heat exchange surface area. When the inlet valve and the outlet valve are closed, the refrigerant flow can be prevented from flowing through the tube portion, and an amount of refrigerant can be stored in the tube portion such that the refrigerant circuit has a second amount of refrigerant circulating therethrough. The second amount can be less than the first amount, and the heat exchanger apparatus can provide a second heat exchange surface area that is less than the first heat exchange surface area.

The refrigerant flow can be permitted to flow through the tube portion when the inlet valve and the outlet valve are open. When the inlet valve and the outlet valve are closed, the refrigerant flow can be prevented from flowing through the tube portion. Closing the inlet valve and the outlet valve can reduce the effective heat exchange surface area of the heat exchanger apparatus. The heat exchange tube can further have an intermediate valve disposed at a position on the heat exchange tube that is between the inlet valve and the outlet valve. The intermediate valve can be a first intermediate valve and the bypass line can fluidly connect the first intermediate valve to the outlet valve via a second intermediate valve.

The heat exchange tube can include one or more hairpin bends, or the heat exchange tube can be in the form of a serpentine coil or a helical coil. The heat exchange tube can also have a predetermined length of line is between the inlet valve and the outlet valve, the predetermined length of line determining a predetermined amount of refrigerant to be stored in the heat exchange tube The heat exchanger apparatus can include a first bypass line between the inlet valve and the outlet valve. The refrigerant flow can be routed through the bypass line when the inlet valve and the outlet valve are closed. The heat exchanger apparatus can also include a second bypass line fluidly connecting the intermediate valve to the outlet valve.

Also disclosed herein are heat exchangers comprising a plurality of heat exchange tubes. The plurality of heat exchange tubes can include a non-selectable heat exchange tube configured to permit a refrigerant to flow therethrough and a selectable heat exchange tube comprising a valve. The selectable heat exchange tube can be configured to permit the refrigerant to flow therethrough when the valve is open. The selectable heat exchange tube can be configured to prevent the refrigerant from flowing through at least a portion of the selectable heat exchange tube when the valve is closed, thereby reducing the effective heat exchange surface area of the heat exchanger. At least a portion of the selectable heat exchange tube can be configured to store a predetermined amount of refrigerant.

The valve can be located proximate an inlet of the selectable heat exchange tube. The valve can be a first valve and the selectable heat exchange tube can further comprise a second heat exchange tube located proximate an outlet of the selectable heat exchange tube. The valve can be located at a location on the selectable heat exchange tube that is between an inlet of the heat exchange tube and an outlet of the heat exchange tube.

The selectable heat exchange tube can further comprise a bypass line extending between the valve and a location nearer the outlet of the heat exchange tube than the inlet of the heat exchange tube. The valve can be a first valve, and the selectable heat exchange tube can further comprise a second valve located at the location nearer the outlet of the heat exchange tube than the inlet of the heat exchange tube.

Also disclosed herein are heat exchanger controllers comprising a processor and a memory. The memory can store instructions that, when executed by the processor, cause the heat exchanger controller to implement one or more methods disclosed herein.

The controller can receive a request to change an effective surface area of the heat exchanger apparatuses disclosed herein. The request can either be to decrease the effective heat exchange surface area or to increase the effective heat exchange surface area. Responsive to receiving the request to decrease the surface area, the controller can output instructions to transition the inlet valve and the outlet valve to a closed position thereby reducing the effective surface area of the heat exchanger. Responsive to receiving the request to increase the surface area, the controller can output instructions to transition the inlet valve and the outlet valve to an open position thereby increasing the effective surface area of the heat exchanger. The request can be indicative of one or more of: a change in temperature, a change in operating speed, or a change in operating mode.

These and other aspects of the present disclosure are described in the Detailed Description below and the accompanying figures. Other aspects and features of examples of the present disclosure will become apparent to those of ordinary skill in the art upon reviewing the following description of specific examples of the present disclosure in concert with the figures. While features of the present disclosure may be discussed relative to certain examples and figures, all examples of the present disclosure can include one or more of the features discussed herein. Further, while one or more examples may be discussed as having certain advantageous features, one or more of such features may also be used with the various examples of the disclosure discussed herein. In similar fashion, while examples may be discussed below as device, system, or method examples, it is to be understood that such examples can be implemented in various devices, systems, and methods of the present disclosure.

BRIEF DESCRIPTION OF THE DRAWINGS

The accompanying drawings, which are incorporated in and constitute a part of this specification, illustrate multiple examples of the presently disclosed subject matter and serve to explain the principles of the presently disclosed subject matter. The drawings are not intended to limit the scope of the presently disclosed subject matter in any manner.

DETAILED DESCRIPTION

Figure 1A:
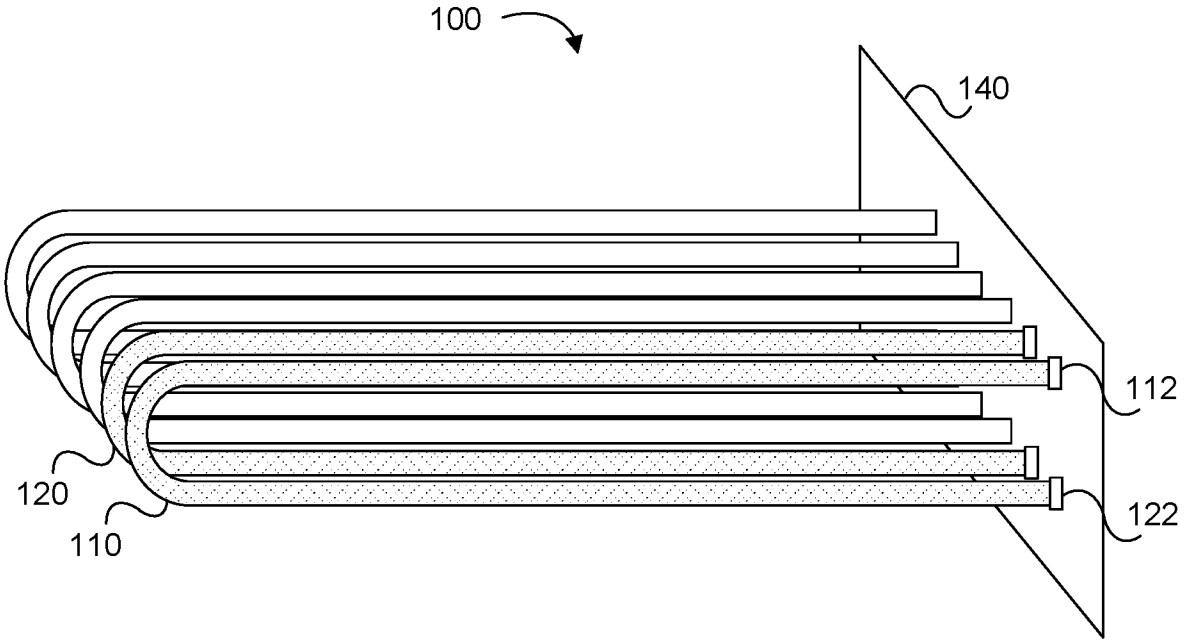
FIG. 1A illustrates a schematic of an example heat exchanger apparatus in accordance with the present disclosure.

As described above, a problem with current air conditioning systems, particularly with heat pump systems, is that a refrigerant imbalance can be caused when there is a difference between an outdoor coil volume and an indoor coil volume. This can be caused because, in addition to volume differences, heat exchanger for multi-speed air conditioning systems are designed to operate at or near capacity during high-speed operation, with no method to correct the capacity during low-speed operation such that the heat exchangers are oversized for low-speed operation. Thus, a refrigerant imbalance can reduce system efficiency when switching between modes (e.g., from heating mode to cooling mode) and/or when switching between speeds (e.g., from low speed to high speed), which can ultimately increase operating costs for the user.

Disclosed herein, therefore, are heat exchanger apparatuses for use with HVAC systems. The heat exchangers can have multiple tubes through which refrigerant (or another working fluid) can flow, and the refrigerant can be used to exchange heat with air passing over the tubes. An inlet valve and an outlet valve can be attached to the tubes, with a bypass line passing therebetween, in order to partition a portion of the heat exchanger's tubes. As such, when the valves are closed, the refrigerant can flow through the bypass line and the heat exchange area can be reduced. Additionally, when the valves are opened, the refrigerant can flow through the partitioned tubes to increase the heat exchange area. In such a manner, the valves can afford a controller, or a user, additional control measures over the heat exchanger.

Additionally, the dynamically configurable tubing in the heat exchanger can act as a charge compensator by selectively storing refrigerant in partitioned tubes, removing the need for an external charge compensator component. Moreover, the disclosed technology provides an additional improvement over traditional charge compensators. Typically, conventional charge compensators are used only to adjust the active charge (i.e., refrigerant in circulation). In contrast, the disclosed technology can both adjust the active charge and change the heat transfer surface area by removing excess tubing from the active refrigerant circuit.

Although certain examples of the disclosure are explained in detail, it is to be understood that other examples and applications are contemplated. Accordingly, it is not intended that the disclosure is limited in its scope to the details of construction and arrangement of components set forth in the following description or illustrated in the drawings. Other examples of the disclosure are capable of being practiced or carried out in various ways. Also, in describing the disclosed technology, specific terminology will be resorted to for the sake of clarity. It is intended that each term contemplates its broadest meaning as understood by those skilled in the art and includes all technical equivalents which operate in a similar manner to accomplish a similar purpose.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified.

The components described hereinafter as making up various elements of the disclosure are intended to be illustrative and not restrictive. Many suitable components that would perform the same or similar functions as the components described herein are intended to be embraced within the scope of the disclosure. Such other components not described herein can include, but are not limited to, for example, similar components that are developed after development of the presently disclosed subject matter.

While the examples illustrated and described herein are described relating to using a refrigerant as the working fluid in a heat exchanger, it is understood that any practical working fluid can be used to conduct a heat exchange. For example, combustion gases can flow through the heat exchanger when the ambient air in contact with the heat exchanger needs to be increased. Additionally, the term "refrigerant" can include any single phase heat transfer fluid, such as those designated as such by, and compliant with, the standards, rules, and regulations set forth by the American Society of Heating, Refrigerating, and Air-Conditioning Engineers (ASHRAE) (e.g., ASHRAE Standard 34-2019). Other examples of refrigerants—which may or may not have a refrigerant designation per ANSI/ASHRAE-34-2019—can include any glycol (and water glycol mixtures), alcohol/water mixtures, and other natural and/or synthetic heat transfer fluids.

Reference will now be made in detail to examples of the disclosed technology, some of which are illustrated in the accompanying drawings. Wherever convenient, the same references numbers will be used throughout the drawings to refer to the same or like parts.

Figure 1B:
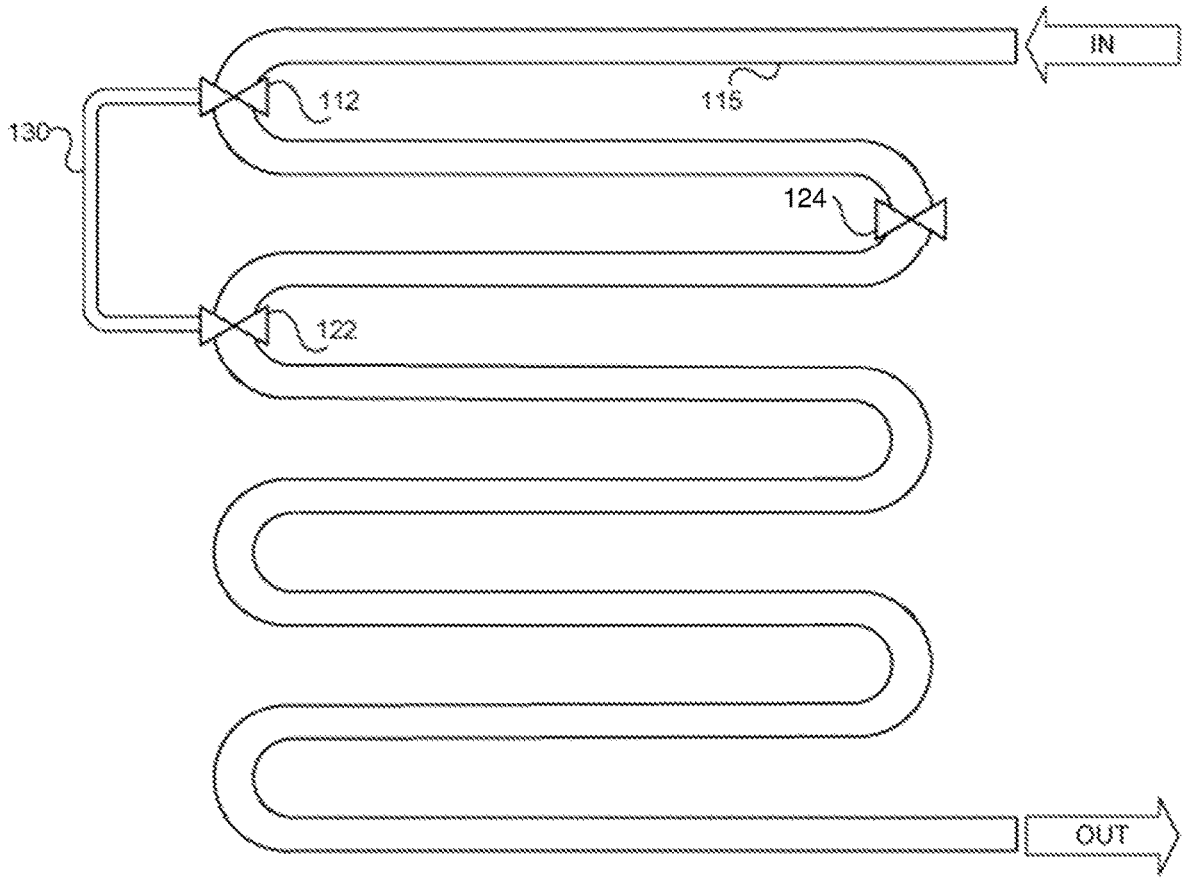
FIG. 1B illustrates a schematic of an example heat exchanger apparatus in accordance with the present disclosure.

Referring to FIGS. 1A and 1B, heat exchangers for HVAC applications, such as the illustrated heat exchanger apparatus 100, traditionally use U-bend heat exchanger tubes 110. Typically, each heat exchanger tube can include two legs and a bend section, as depicted in FIG. 1A. The U-bend tubes generally have a bend section that has semi-circular bend, and the semi-circular bend often has constant radius. That being said, some heat exchangers include other designs of tubes 110. The tubes 110 can be substantially hollow such that fluid can flow from an inlet of a given heat exchanger tube 110 to an outlet of the given heat exchanger tube 110. The heat exchanger tubes can include fins, ridges, and/or certain geometries to improve heat transfer, such as is disclosed by U.S. Pat. No. 10,415,892, the contents of are incorporated in their entirety as if fully set forth herein.

The first heat exchanger tube 110 can have an inlet valve 112 through which fluid can enter the heat exchanger apparatus 100 and an outlet valve 122 through which fluid can exit the heat exchanger apparatus. The heat exchanger apparatus 100 can have multiple similarly configured tubes to improve the efficiency of the heat exchange. Any number of tubes can be controlled by the inlet valve 112 and the outlet valve 122, such as the first heat exchanger tube 110 and the second heat exchanger tube 120. The inlet valve 112 and the outlet valve 122 can be placed such that fluid can pass through any number of heat exchanger tubes. For greater control, each heat exchanger tube can have its own inlet valve and outlet valve. In such a manner, the amount of tubes participating in the heat exchange can be varied, and the amount of refrigerant stored in inactive tubes can be altered.

The amount of refrigerant stored can be determined by the number of tubes 110, 120 outfitted with valves 112, 122 and the number of tubes 110, 120 that are removed from the refrigerant circuit by the valves 112, 122. For example, if the second heat exchanger tube 120, or a third heat exchanger tube (or any number of tubes), has an inlet valve 112 and an outlet valve 122, a greater amount of refrigerant can be stored within the tubes, which can correspond to a greater decrease in the effective heat exchange area of the heat exchanger apparatus 100. The amount of refrigerant can be altered based on the number of tubes 110, 120 that are removed from the refrigerant circuit.

The heat exchanger apparatus 100 can also be in the form of a singular tube 115, such as a coil, having multiple bend sections. The tube 115 or coil can be in a serpentine configuration, as depicted in FIG. 1B, or can be in any other configuration, such as a helical configuration. As shown in FIG. 1B, the heat exchanger apparatus 100 can also have a bypass line 130 between an inlet valve 112 and an outlet valve 122 such that the refrigerant can flow therebetween without passing through a portion of the first heat exchanger tube 110. In such a manner, the effective heat exchange area of the heat exchanger apparatus 100 can be altered using the inlet valve 112 and the outlet valve 122. The bypass line 130 can also include one or more fins or ridges such that the bypass line 130 can be included in the heat exchange. In such a manner, the bypass line 130 can alter the effective heat exchange area.

Figure 1C:
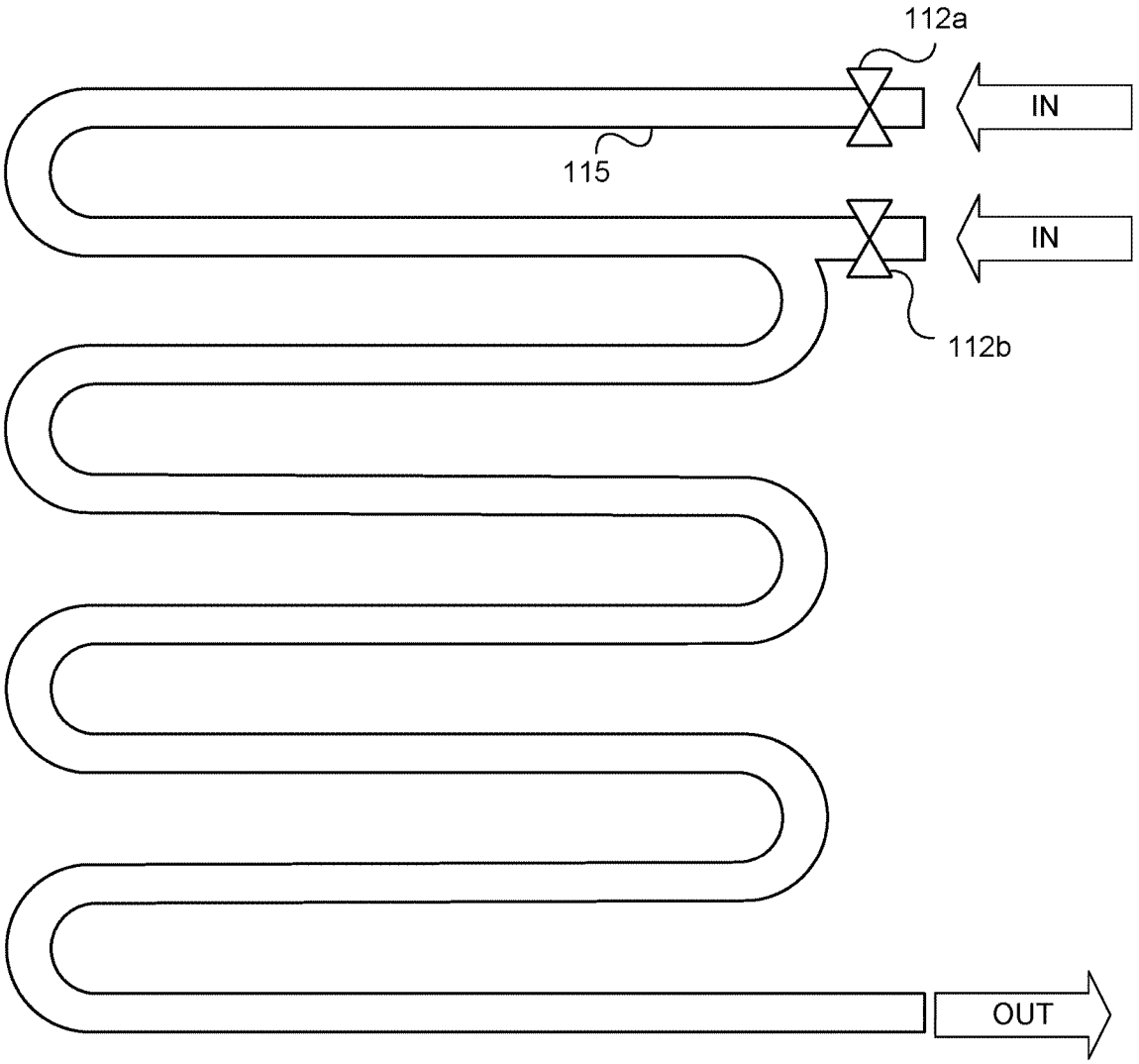
FIG. 1C illustrates a schematic of an example heat exchanger apparatus in accordance with the present disclosure.

As shown in FIG. 1C, multiple inlet valves (112*a* and 112*b*) can control the refrigerant flow into the heat exchanger apparatus 100. Closing inlet valve 112*a* routes the fluid through inlet valve 112*b*, thereby decreasing the surface area of the heat exchanger apparatus 100. Likewise, opening inlet valve 112*a* and closing inlet valve 112*b* increases the surface area of the heat exchanger apparatus 100. The multiple inlet valves (112*a* and 112*b*) can be positioned any distance apart such that any predefined length of tubing 115 can be between the two valves 112*a*, 112*b*. Optionally, a third valve (not shown) can be positioned along the tube 115 between the first valve 112*a* and the intersection proximate the second valve 112*b*. The third valve can open and close in conjunction with the first valve 112*a* (e.g., when the first valve 112*a* is open, the third valve is open). In such a manner, when the first valve 112*a* is closed, the check valve can also close to create a liquid-tight seal separating the portion of the tubing 115 between the first valve and the third valve from the remainder of the refrigerant circuit. This can sequester a portion of the refrigerant in the tubing 115 between the first valve 112*a* and the third valve to act as a charge compensator and to reduce the effective surface area of the heat exchanger apparatus 100. Optionally, the third valve can be a one-way valve (e.g., a check valve), which can permit flow therethrough when the first valve 112*a* is open and sequester refrigerant when the first valve 112*a* is closed.

That being said, an amount of refrigerant can be removed from circulation and stored in the tubing 115, even without the optional third valve. For example, the configuration illustrated in FIG. 1C (i.e., without a third valve), can still decrease the heat transfer surface area of the heat exchanger apparatus 100 and contain some amount of refrigerant in the length of tubing downstream of the first valve 112*a* and upstream of the second valve 112*b*. This is because the entirety of the tubing 115 is internally pressurized, and a vacuum is created in the length of tubing downstream of the first valve 112*a* and upstream of the second valve 112*b* such that it is not possible for all of the refrigerant to be drawn out from that portion of the tubing 115. Thus, some refrigerant can be contained inside the length of tubing downstream of the first valve 112*a* and upstream of the second valve 112*b*, and this quantity of refrigerant does not effectively or fully circulate through the refrigerant circuit.

When closed, the inlet valve 112 and the outlet valve 122 can store an amount of refrigerant in the portion of the tube 115 located between the inlet valve 112 and the outlet valve 122, thereby reducing the amount of the tube 115 that is able to provide heat transfer. Closing the inlet valve 112 and the outlet valve 122 can also cause the refrigerant to flow through the bypass line 130. When open, the inlet valve 112 and the outlet valve 122 can cause the refrigerant to flow through the first heat exchanger tube 110 and any additional predetermined length of tubing therebetween. For example, the refrigerant can flow through two or more bends in the tube 115, as shown. Alternatively, or additionally, any number of tubes, or any predetermined length of tubing, can be between the inlet valve 112 and the outlet valve 122.

Additionally, a predetermined amount of refrigerant can be stored between the inlet valve 112 and the outlet valve 122 when the bypass line 130 is in use. In such manner, a refrigerant charge can be stored between the inlet valve 112 and the outlet valve 122 for later circulation and use. For example, the stored refrigerant charge can be added or removed when transitioning the air conditioning system from heating mode to cooling mode, and vice versa. Such a configuration can eliminate the need for an external charge compensator and improve the efficiency of the overall air conditioning system. The amount of refrigerant stored can be determined by the positions of the inlet valve 112 and the outlet valve 122.

Furthermore, the tube 115 can include one or more intermediate valves located along the tube 115 between the inlet valve 112 and the outlet valve 122. For example, the tube 115 can include an intermediate valve 124 located between the inlet valve 112 and the outlet valve 122 to define a first portion between the inlet valve 112 and the intermediate valve 124 and a second portion between the intermediate valve 124 and the outlet valve 122. The tube 115 can include the first bypass line 130 between the inlet valve 112 and the outlet valve 122, as shown in FIG. 1B, and can also include a second bypass line 130 between the intermediate valve 124 and the outlet valve. Thus, if the inlet valve 112 and outlet valve 122 are closed, a relatively larger amount of refrigerant can be stored in both the first and second portion with circulating refrigerant flowing through the first bypass line 130, whereas if the intermediate valve and the outlet valve 122 are closed, a relatively smaller amount of refrigerant can be stored in the second portion with circulating refrigerant flowing through the first portion and the second bypass line 130.

This concept can be similarly extended to the U-bend tubes 110, 120 shown in FIG. 1A. That is to say, an intermediate valve can be located along the U-bend tube 110, 120 between the inlet valve 112 and the outlet valve 122, and a bypass line 130 can extend between the intermediate valve and the outlet valve 122 such that, when the inlet valve 112 is open and the intermediate valve and outlet valve 122 are closed, circulating refrigerant can flow through a first portion of the U-bend tube 110 and through the bypass line 130 extending from the intermediate valve to the outlet valve 122 while an amount of refrigerant is removed from circulation and stored in a second portion between the intermediate valve and the outlet valve 122.

The heat exchanger apparatus 100 can include a tube plate 140 configured to maintain the heat exchanger tubes in a desired configuration, as shown in FIG. 1A. The tube plate 140 can include an aperture for each open end of a heat exchanger tube such that fluid communication is facilitated between the interior of each heat exchanger tube and other components of the heat exchanger apparatus 100 and/or a corresponding furnace or other heat transfer assembly. As an example, the interior of each heat exchanger tube can be in fluid communication with an inlet assembly of the heat exchanger apparatus 100 via ingress apertures of the tube plate 140, and the inlet can be configured to receive combustion gases or another fluid (e.g., refrigerant) for transferring heat. For example, in the case of an air conditioning system, the inlet can be configured to receive a refrigerant from a condenser in which the refrigerant is cooled. That is, cool refrigerant can flow sequentially through the inlet of the heat exchanger apparatus 100, through the ingress apertures of the tube plate 140, through the bottom straight section of each heat exchanger tube, through the bend sections of each heat exchanger tube, through the top straight section of each heat exchanger tube, through the egress apertures of the tube plate 140, and to an outlet (not shown).

The inlet valve 112 and the outlet valve 122 can be positioned at any point along the tube 115. The positions of the valves can be varied depending on the desired reduction in surface area and/or the desired volume of fluid to be stored in the tubes. The inlet valve 112 and the outlet valve 122 can also be positioned proximal one another (e.g., both on the u-bend side) or distal one another (e.g., on opposing u-bend sides).

The inlet valve 112 and the outlet valve 122 can be any valve configured to selectively permit fluid to pass, which can include, but is not limited to, ball valves, butterfly valves, choke valves, diaphragm valves, gate valves, globe valves, knife valves, needle valves, pinch valves, piston valves, plug valves, solenoid valves, spool valves, and the like. Other valves or other mechanical configurations to selectively permit refrigerant to flow can be used, such as rupture discs or regulators. Additionally, the inlet valve 112 and the outlet valve 122 need not be the same type of valve, though it is understood that the inlet valve 112 and the outlet valve 122 can be similar valves for consistency or other performance reasons.

Figure 2:
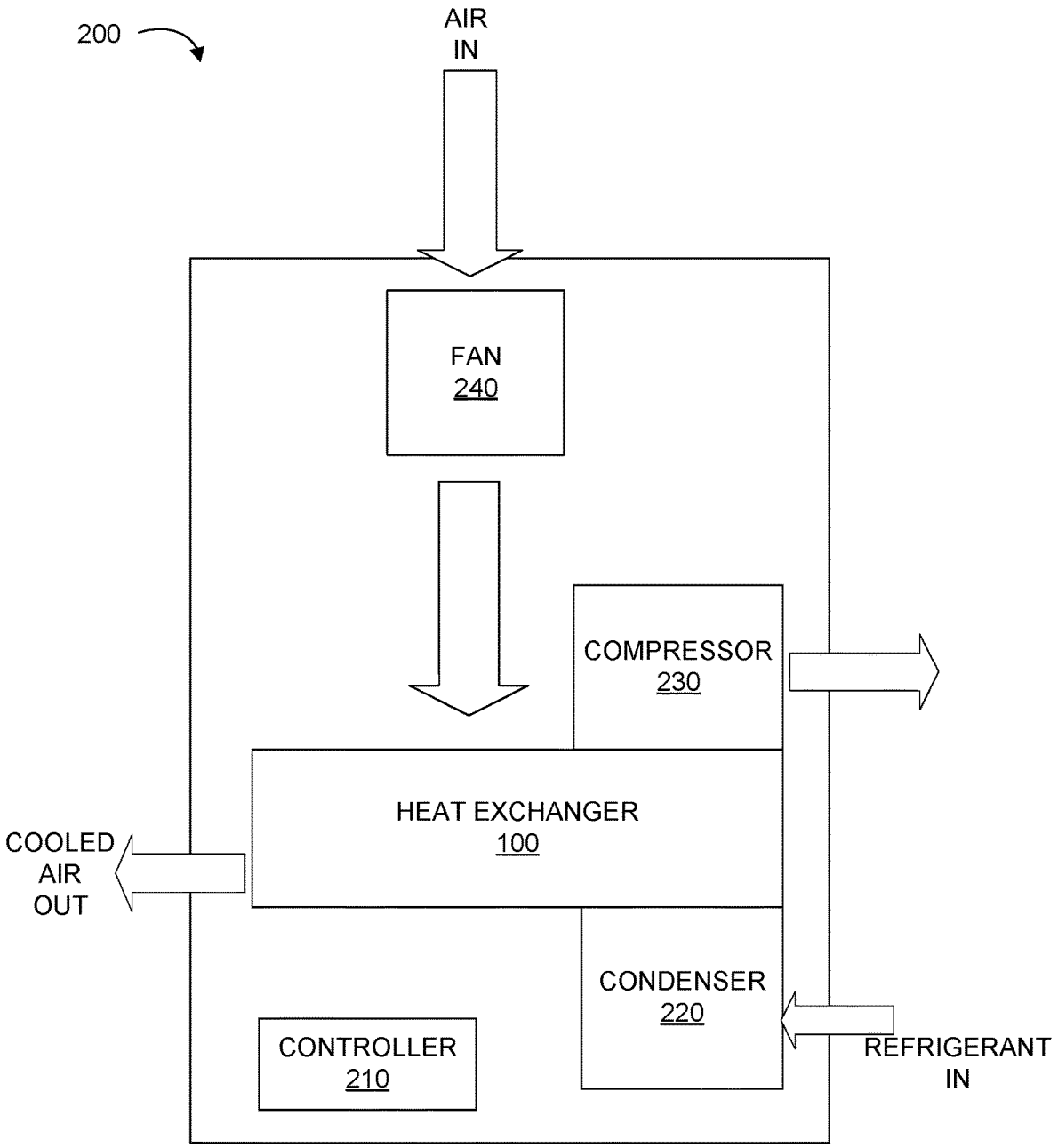
FIG. 2 illustrates a component diagram of an air conditioning system using an example heat exchanger apparatus in accordance with the present disclosure.

FIG. 2 illustrates a schematic diagram of an air conditioning system 200. The system 200 can include a heat exchanger apparatus 100 according to the instant disclosure, a condenser 220 to provide cold refrigerant through the heat exchanger apparatus 100, and a compressor 230 (e.g. a centrifugal compressor, a scroll compressor, a rotary compressor, etc.) to force the refrigerant through the interior of the heat exchanger apparatus 100. The system 200 can include an indoor fan and/or blower 240 to force air toward the heat exchanger tubes of the heat exchanger apparatus 100 such that heat can be transferred, via the heat exchanger tubes, from the flowing air to the refrigerant. Cooled air can thus be provided to a building, a portion of a building, or some other space. The system 200 can include a controller 210, which can be configured to control the compressor 230, the fan 240, a thermal expansion valve (not shown), and/or other components of the system 200, such as various valves and pumps. It is to be understood that the arrangement of the components in FIG. 2 is provided for the sake of illustration and not limitation. Other configurations of the system 200 are understood to be within the scope of the present disclosure. For instance, the compressor 230, heat exchanger apparatus 100, and the condenser 220 need not be in close proximity. Rather, any amount of piping or tubing can be present between said components. In a split air conditioning system, for example, the condenser 220 and the compressor 230 can be in an outdoor unit while the heat exchanger apparatus 100 remains in an indoor unit.

While the present disclosure is discussed with respect to air conditioning systems for cooling air, as shown in FIG. 2, it is understood that the heat exchanger apparatuses of the present disclosure can also be used in conjunction with heating systems for heating air. For example, the heat exchanger apparatus 100 can be used in conjunction with a gas furnace.

The gas furnace can include a heat exchanger apparatus 100 according to the instant disclosure, a combustion chamber to provide hot combustion gases through the heat exchanger apparatus 100, and a blower (e.g. a combustion blower) to force the combustion gases through the interior of the heat exchanger apparatus 100. The furnace can include an indoor to force air toward the heat exchanger tubes of the heat exchanger apparatus 100 such that heat can be transferred, via the heat exchanger tubes, from the hot combustion gases and to the flowing air. Heated air can thus be provided to a building, a portion of a building, or some other space. The furnace can include a controller, which can be configured to control the blower, the indoor blower, a fuel valve (not shown), and/or other components of the furnace.

Figure 3:
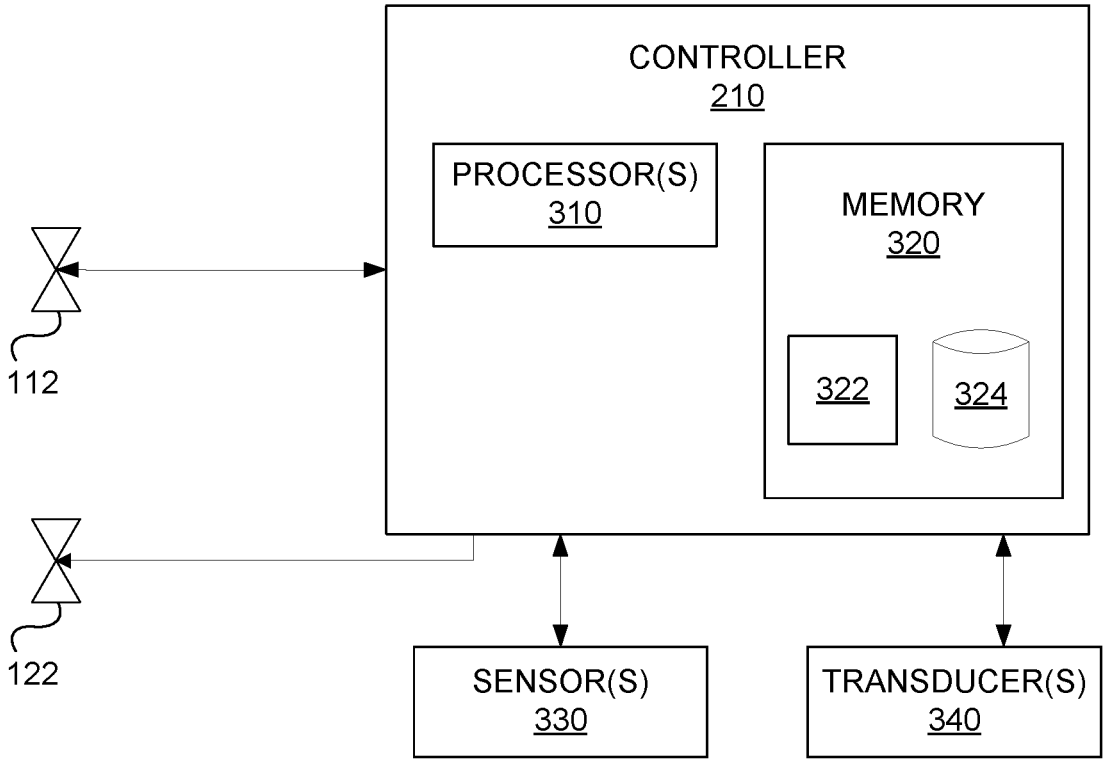
FIG. 3 illustrates a component diagram of an example controller for a heat exchanger apparatus in accordance with the present disclosure.

As shown in FIG. 3, the controller 300 can comprise a variety of components for receiving and processing data, as well as components to output instructions. For instance, the controller 300 can comprise one or more processors 310 and memory 320, which can include a program 322 and/or one or more storage devices 324. It should be understood that the controller 300 can receive data from various sensors, process the data, and output one or more instructions to perform one, some, or all of the various functionalities described herein. The controller 300 can also be in communication with one or more sensors 330 and/or one or more transducers 340. As such, the controller 300 can be receiving intermittent or continuous data relating to the operation of the heat exchanger apparatus 100.

The one or more sensors 330 and/or transducers 340 can include, for example, a temperature sensor within the heat exchanger apparatus, a temperature sensor external to the heat exchanger apparatus, a flow sensor within the heat exchanger apparatus, a flow sensor outside the heat exchanger apparatus, a humidity sensor within an indoor space, a temperature sensor within an indoor space, and/or similar sensors placed in various locations.

The controller 300 can also be connected to and in communication with the inlet valve 112 and the outlet valve 122. The controller 300 can transition the inlet valve 112 and the outlet valve 122 between the open state and the closed state. The controller 300 can receive certain data inputs (e.g., from the one or more sensors 330 or from a user interface) and, in response, transition one (or both) of the inlet valve 112 and the outlet valve 122 between the open and closed states. For example, the controller can receive (e.g., from a temperature sensor) that an indoor temperature has been increased. As such, the controller 300 can determine that a capacity of the air conditioning system 200 should be increased. Therefore, the controller 300 can instruct both the inlet valve 112 and the outlet valve 122 to open, thus increasing the surface area of the heat exchanger apparatus 100. It should be understood that, in addition to the controller 300 controlling both the inlet valve 112 and the outlet valve 122, each of the inlet valve 112 and the outlet valve 122 can have its own respective controller.

The controller can also comprise an analog system. For instance, the controller can be connected to a temperature sensing bulb, such as a temperature sensing bulb in a thermal expansion valve. Other analog temperature and pressure sensors can be used in conjunction with analog systems to implement changes to the inlet valve 112, the outlet valve 122, or to other components of the heat exchanger apparatus 100. For example, the controller can comprise one or more hydraulic lines, pistons, actuators, solenoids, and the like.

Figure 4:
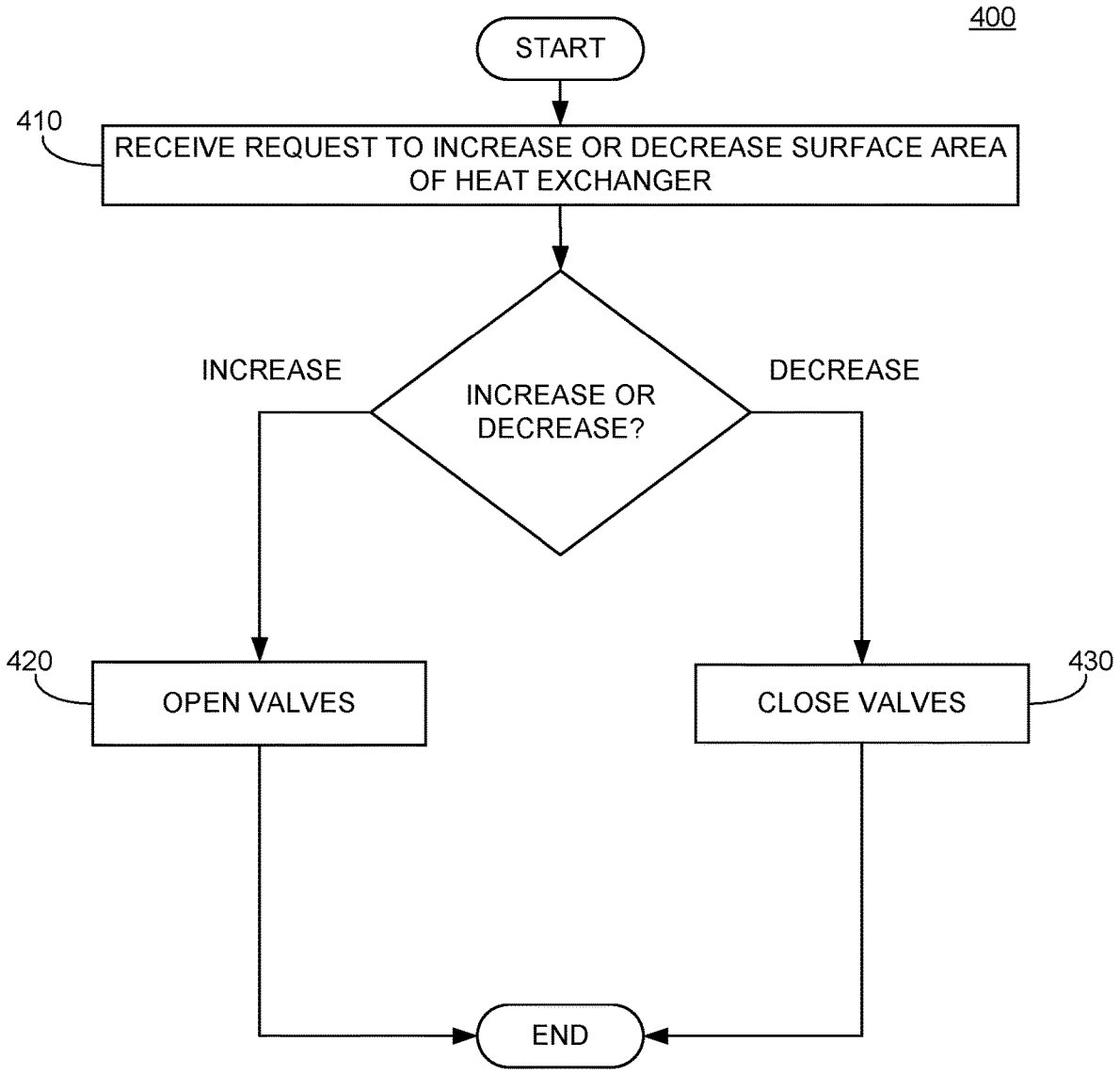
FIG. 4 illustrates a flowchart of an example method for controlling a heat exchanger apparatus in accordance with the present disclosure.

FIG. 4 illustrates a method 400 for controlling a heat exchanger apparatus 100 in accordance with the present disclosure. While the method 400 is described below with respect to the controller 300, it is understood that the method 400 can be implemented by any similar systems. Additionally, the method 400 is not limited to the heat exchanger apparatus 100. Rather, the method 400 can control any of the heat exchangers disclosed herein.

As shown, in block 410, the controller 300 can receive a request to alter the surface area of the heat exchanger apparatus 100. The request can be to increase the surface area (e.g., if a higher compressor operating speed is desired) or to decrease the surface area (e.g., if a lower compressor operating speed is desired). The request can be received from an external source, such as a thermostat inside of a residential building. Alternatively, or additionally, the request can be related to a transition to a new operating mode for the heat exchanger apparatus 100, the air conditioning system 200, or the like. Alternatively, or additionally, the controller 300 can generate the request automatically upon analyzing received data (e.g., from the one or more sensors 330). If the request is to increase the surface area of the heat exchanger apparatus 100, the method can then proceed to block 420. If the request is to decrease the surface area of the heat exchanger apparatus 100, the method can then proceed to block 430.

In block 420, the controller 300 can instruct the inlet valve 112 and the outlet valve 122 to transition from closed to open. This can allow refrigerant (or other fluid) to flow through the first heat exchanger tube 110 and the second heat exchanger tube 120, thereby increasing the heat exchange area. The method 400 can terminate after block 420 or proceed on to other blocks of the method 400.

In block 430, the controller 300 can instruct the inlet valve 112 and the outlet valve to transition from open to closed. This can prevent refrigerant (or other fluid) from flowing through the first heat exchanger tube 110 and the second heat exchanger tube 120, thereby decreasing the heat exchange area. The method 400 can terminate after block 430 or proceed on to other blocks of the method 400.

While the present disclosure has been described in connection with a plurality of example aspects, as illustrated in the various figures and discussed above, it is understood that other similar aspects can be used, or modifications and additions can be made to the described aspects for performing the same function of the present disclosure without deviating therefrom. For example, in various aspects of the disclosure, methods and compositions were described according to aspects of the presently disclosed subject matter. However, other equivalent methods or composition to these described aspects are also contemplated by the teachings herein. Therefore, the present disclosure should not be limited to any single aspect, but rather construed in breadth and scope in accordance with the appended claims.

Example Use Case

The following examples describe examples of a typical user flow pattern. They are intended solely for explanatory purposes and not limitation.

During the early morning, a user's air conditioning system may be operating under a low-speed configuration because the temperature inside the user's house has not heated up yet. As such, the heat exchanger in the air conditioning system can operate at a reduced surface area because less heat transfer is needed. The inlet and outlet valves can therefore be closed, and the bypass line can be in use to flow refrigerant through the heat exchanger.

As the day heats up the interior of the user's house, the thermostat measuring the temperature inside the house can indicate that additional cooling is needed. The thermostat can send the data to a controller of the air conditioning system. Upon receiving the request for additional cooling, the controller can determine that the surface area of the heat exchanger should be increased. The controller can then open the inlet valve and the outlet valve, allowing the refrigerant to flow through extra tubes in the heat exchanger thereby increasing the surface area.

What is claimed is:

1. A heat exchanger apparatus comprising:

a heat exchange tube configured to direct a refrigerant flow therethrough, the heat exchange tube having an inlet valve, an outlet valve, an intermediate valve disposed between the inlet valve and the outlet valve, a tube portion being defined between the inlet valve and the outlet valve, and a bypass line fluidly connecting the intermediate valve to the outlet valve, wherein the heat exchanger apparatus is configured to fluidly communicate with a refrigerant circuit and when the inlet valve and the outlet valve are open, (i) the refrigerant flow is permitted to flow through the tube portion such that the refrigerant circuit has a first amount of refrigerant circulating therethrough and (ii) the heat exchanger apparatus provides a first heat exchange surface area, wherein when the inlet valve and the outlet valve are closed, (i) the refrigerant flow is prevented from flowing through the tube portion, (ii) a predetermined amount of refrigerant is stored in the tube portion such that the refrigerant circuit has a second amount of refrigerant circulating therethrough, the second amount being less than the first amount, and (iii) the heat exchanger apparatus provides a second heat exchange surface area that is less than the first heat exchange surface area.

2. The heat exchanger apparatus of claim 1, wherein the heat exchange tube includes one or more hairpin bends.

3. The heat exchanger apparatus of claim 1, wherein the heat exchange tube is a serpentine coil or a helical coil.

4. The heat exchanger apparatus of claim 1 further comprising a bypass line between the inlet valve and the outlet valve.

5. The heat exchanger apparatus of claim 4, wherein the refrigerant flow is routed through the bypass line when the inlet valve and the outlet valve are closed.

6. The heat exchanger apparatus of claim 1, wherein the intermediate valve is a first intermediate valve and the bypass line fluidly connects the first intermediate valve to the outlet valve via a second intermediate valve.

7. A heat exchanger controller comprising:

one or more processors; and memory storing instructions that, when executed by the one or more processors, cause the heat exchanger controller to:

receive a request to change an effective heat exchange surface area of a heat exchanger, the heat exchanger including a heat exchanger tube having an inlet valve, an outlet valve, an intermediate valve disposed between the inlet valve and the outlet valve, and a bypass line that connects the intermediate valve to the outlet valve;

responsive to the request being (i) a request to decrease the effective heat exchange surface area or (ii) a request to reduce a refrigerant charge quantity circulating through an active refrigerant circuit, output instructions for the inlet valve and the outlet valve to transition to a closed position, thereby storing a predetermined amount of refrigerant between the inlet valve and the outlet valve, thereby reducing the effective heat exchange surface area of the heat exchanger; and responsive to the request being (i) a request to increase the effective heat exchange surface area or (ii) a request to increase the refrigerant charge quantity circulating through the active refrigerant circuit, output instruction for the inlet valve and the outlet valve to transition to an open position, thereby releasing the predetermined amount of refrigerant from between the inlet valve and outlet valve and permitting the refrigerant to flow through the heat exchanger tube, thereby increasing the effective heat exchange surface area of the heat exchanger.

8. The heat exchanger controller of claim 7, wherein a predetermined length of line is between the inlet valve and the outlet valve, the predetermined length of line determining the predetermined amount of refrigerant to be stored.

9. The heat exchanger controller of claim 8, wherein the predetermined length of line includes one or more hairpin bends.

10. The heat exchanger controller of claim 7, wherein:

the heat exchanger tube is a first heat exchanger tube of a plurality of heat exchanger tubes, the inlet valve is a first inlet valve, and the outlet valve is a first outlet valve, the plurality of heat exchanger tubes comprises a second heat exchanger tube, the second heat exchanger tube comprising a second inlet valve and a second outlet valve, and the heat exchanger controller is configured to output instructions to selectively open and close the first inlet valve, the first outlet valve, the second inlet valve, and the second outlet valve.

11. The heat exchanger controller of claim 7, wherein the request is indicative of one or more of: a change in temperature, a change in operating speed, or a change in operating mode.

12. A heat exchanger comprising:

a plurality of heat exchange tubes comprising:

a non-selectable heat exchange tube configured to permit a refrigerant to flow therethrough; and a selectable heat exchange tube comprising an inlet valve, an outlet valve, an intermediate valve disposed between the inlet valve and the outlet valve, and a bypass line that connects the intermediate valve to the outlet valve, wherein the selectable heat exchange tube is configured to permit the refrigerant to flow therethrough when the inlet valve is open, wherein the selectable heat exchange tube is configured to prevent the refrigerant from flowing through at least a portion of the selectable heat exchange tube when the inlet valve is closed, thereby reducing an effective heat exchange surface area of the heat exchanger, and wherein the at least the portion of the selectable heat exchange tube is configured to store a predetermined amount of refrigerant.

13. The heat exchanger of claim 12, wherein each of the plurality of heat exchange tubes has a hairpin shape.

14. The heat exchanger of claim 12, wherein the inlet valve is located proximate an inlet of selectable heat exchange tube.

15. The heat exchanger of claim 14, wherein the outlet valve is located proximate an outlet of the selectable heat exchange tube.

16. The heat exchanger of claim 12, wherein the intermediate valve is located at a location on the selectable heat exchange tube that is between an inlet of the selectable heat exchange tube and an outlet of the selectable heat exchange tube.

17. The heat exchanger of claim 16, wherein the selectable heat exchange tube further comprises a bypass line extending between the inlet valve and a location nearer the outlet of the selectable heat exchange tube than the inlet of the selectable heat exchange tube.

18. The heat exchanger controller of claim 17, wherein the outlet valve is located at the location nearer the outlet of the selectable heat exchange tube than the inlet of the selectable heat exchange tube.

* * * * *